US008418294B1

(12) United States Patent
Davis

(10) Patent No.: US 8,418,294 B1
(45) Date of Patent: Apr. 16, 2013

(54) ADJUSTABLE HAIRSTYLE PROTECTING PILLOW

(76) Inventor: Demetrius Davis, Hurlock, MD (US)

( * ) Notice: Subject to any disclaimer, the term of this patent is extended or adjusted under 35 U.S.C. 154(b) by 0 days.

(21) Appl. No.: 13/507,220

(22) Filed: Jun. 13, 2012

(51) Int. Cl.
*A47C 20/02* (2006.01)

(52) U.S. Cl.
USPC ..... 5/640; 5/636; 5/630

(58) Field of Classification Search ..... 5/630, 636, 5/622, 640, 655.9, 657
See application file for complete search history.

(56) References Cited

U.S. PATENT DOCUMENTS 2,661,050 A * 12/1953 Felter ..... 297/391
3,477,761 A * 11/1969 Krantz ..... 297/409
3,757,365 A * 9/1973 Kretchmer ..... 5/636

* cited by examiner

*Primary Examiner* — Fredrick Conley

(57) ABSTRACT

A adjustable hairstyle protecting pillow unit complete (FIG. 1), design and function for providing adjustability to the user due to the many different comfort levels of consumers. A user of this invention can with a push of a button adjust the unit to their desired comfortable position at any comfort level when sleeping or relaxing anywhere the user desire. The unit provides to the user a high density triple layer extremely soft memory foam to sleep and relax on which conforms to the neck ,face or ear. Thus a considerably more versatile hairstyle protecting pillow unit is provided and arisen-that can be adjusted to provide more flexibility.

1 Claim, 1 Drawing Sheet

| NO | PRT-NAME | QTY |
|---|---|---|
| 1 | ANTIAS_1 | 1 |
| 2 | DVS003-12010_1 | 2 |
| 3 | RR-1_2 | 1 |
| 4 | RR-2_2 | 1 |
| 5 | FE_1 | 1 |
| 6 | HINGE-1_1 | 2 |
| 7 | HINGE-2_1 | 2 |
| 8 | PRT0001_1 | 2 |
| 9 | PRT0002_1 | 2 |
| 10 | QI_1 | 1 |
| 11 | SPRING_1 | 1 |
| 12 | SPRING_1 | 2 |
| 13 | TOP-COVER_1 | 1 |
| 14 | TT_1 | 1 |
| 15 | WQ_1 | 1 |

| ITEM | PART-NAME | QTY |
|---|---|---|
| 1 | AN/IAS_1 | 1 |
| 2 | DVS001-12010_1 | 2 |
| 3 | ER-1_2 | 1 |
| 4 | ER-2_2 | 1 |
| 5 | FR__1 | 1 |
| 6 | HINGE-1_1 | 2 |
| 7 | HINGE-2_1 | 2 |
| 8 | PRT0001__1 | 2 |
| 9 | PRT0002_1 | 2 |
| 10 | QL__1 | 1 |
| 11 | SPRING__1 | 1 |
| 12 | SPRING_1 | 2 |
| 13 | TOP-OPEN_1 | 1 |
| 14 | TT__1 | 1 |
| 15 | WQ__1 | 1 |
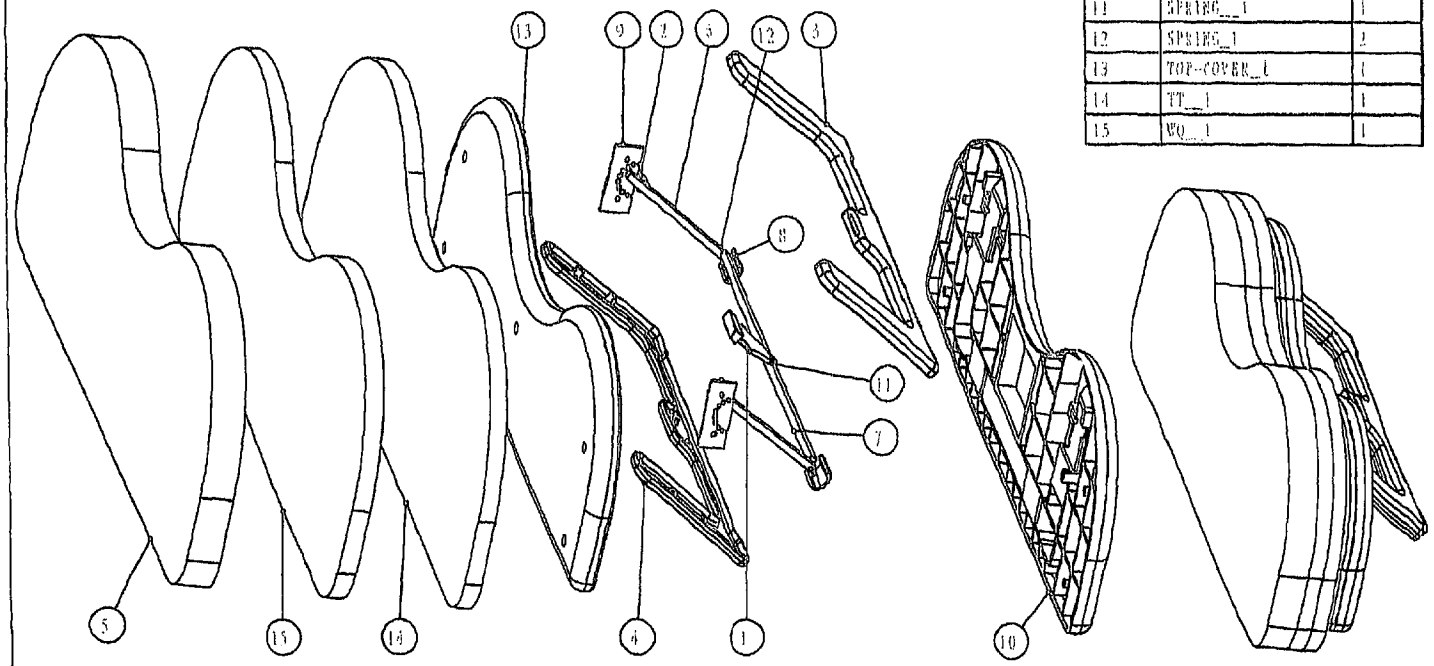

ADJUSTABLE HAIRSTYLE PROTECTING PILLOW

CROSS-REFERENCE TO RELATED APPLICATIONS

This application claims the benefit of provisional application Ser. No. 61/519,458 filed 2011 May 23 by the present inventor.

FEDERALLY SPONSORED RESEARCH

None

SEQUENCE LISTING

None

BACKGROUND- FIELD OF INVENTION

This invention relates to pillows that protect all hairstyles, while delivering a therapeutic very Comfortable experience.

BACKGROUND- PRIOR ART

This invention relates to hairstyle protecting pillows, specifically to adjustable hairstyle protecting pillows having means that allow users to adjust the unit to their desired comfortable secure position. Standard pillows do not provide the needed secure position or design that will accommodate the user to elevate their hair above the mattress to avoid being smashed or ruined while still providing a very comfortable nights sleep. Women, girls, and men all express a need for a reliable way to maintain their hairstyles for the next day or longer. This very unique adjustable hairstyle protecting pillow is designed with a wide u-shape contour that allows the user to rest the neck at all positions and lower parts of the head. The wide u-shape not only gives the user a comfortable elevation but its contour shape comprises of the equivalent of a right and left side sleeping pad that support the user for side sleeping. This design supports all sleeping positions. The actual pillow is made of a triple layer high density memory foam that conforms to the user. The back side of the unit includes a support body cover A and B, which B is securely afitted with a adjustable height bar that has a single push lock and release button. This bar is solely for the purpose of adjusting the unit to the users desired sleeping or resting height. Primarily, females adapt to the new fashion trends, go to special events or occassions, so they have their hair styled on a regular bases which brings about their preservation desire for this unit(Invention). A fitted satin pillowcase will accompany this unit and will provide additional protection against hair breakage.

An attempt was disclosed in Pro. Pat. Application No. 61/011,264 to Burns (2008) . The Burns disclosure is directed to a foam rectangular upper region with round periphery, an off centered square recess opening in which receives the ear of users, a elongated poly-fil material constructs bottom section. The two units are sewn together, designed for elevating and supporting a lower portion of the head, face, neck, and shoulder of user. Top section of head and hair suspend over pillow, aiding in a maintained look of the pervious day. A satin rectangular pillowcase with an off centered opening matches pillow opening allowing precise positioning of the ear in a side or stomach position of user, a zipper encases the dimensional size pillow. While this unit has the capability to support the purpose, it lacks the ability to be height adjusted to a selected desired position of the user. This product also lacks high density triple layer memory foam that conforms to the comfort of the user.

One method used related to head rests for supporting the head over the hair while lying down or on a reclining board to prevent the head from resting on rollers or crushing and disarranging the hairstyle is shown in U.S. Pat. No. 3,296,634 to Rusnak (1967). He claims a head rest to support the head free of the hair consisting of a base which extends forwardly with a loop that projects upwardly and back over said base to provide a top in overlying spaced relation with said base ,comb tine means included in said top to engage the head when extending through the hair about the back of the head and allowing the hair to be suspended between said base and said top, and said base having transversely convexly curved under surface to permit said base and said top to roll sideways with the head of the wearer. However, again there is no method of adjustability concerning height desire for the user nor the availability as said to provide extreme comfort (Memory Foam) while sleeping or resting without restrictions (Neck Straps). Jones, in U.S. Pat. No. 2,239,003 which displays a headrest of the type for supporting the head by engagement with the face of the person while lying on the stomach with the face down. He claims also the capacity of the rest for vertical adjustment relative to its base. While this design provides adjustability unlike the others, its targeted to face down on the stomach users only. He doesn't claim for the intended purpose to be an all around hairstyle protecting pillow, which users require for the reason that they sleep on their backs, both sides and stomach. Therefore, this invention lacks the design, function, and capability to fulfill the desired need.

SUMMARY

The invention, an improved hairstyle protecting pillow, has a user-friendly single press lock/release adjustable bar that will accommodate the user when desiring changes in height for comfort purposes. This bar has an 150 degree angle opening from the base to ensure enough height adjustment .Non-adjustable standard pillows can now be replaced with this unit to fulfill the desire to protect the hairstyles completely while sleeping or resting in all positions. The design incorporates a three layer high density memory foam of extreme softness with a contour is a lightweight unit that can be easily transported when traveling and has a fitted silk pillow case with velcro fasteners when packaged and on the go.

DRAWINGS

FIG. 1 is a perspective complete breakdown view of each part constructed to build the adjustable hairstyle protecting pillow in full in accordance with the invention showing all parts till completion.

DETAILED DESCRIPTION

FIG. 1 is a view of the complete parts to build the adjustable hairstyle protector unit in full showing completion in accordance with the invention. An internal assisting an external 1 release/lock button is supported and function with pushing bar inside A & B 2. Support bracket side A 3 encases the internal functions along with support bracket side B 4 made of a plastic covering. Layer one is a high density memory foam (fast spring) 5 . Internal function to assist lock/release is the hinge shaft 6 as well as its counterpart 7. Rubber feet 8 is to assist to avoid slipping on various fabrics therefore providing grip. Locking side bracket 9 has many lock-in positions to meet users desired height on both sides internally. Body cover B 10 is only the back casing that embodies the unit and is connected to the support bracket 3 & 4. Spring 11 and 12 are also internal parts to make the adjustable bar function properly when locking and releasing. Body cover A 13 is the front half of Body cover B 10 that encases the internal parts. High density memory foam (slow spring) 14 is the second layer of the memory foam that's bonded together to support comfort. Last, high density memory foam (slow spring) 15 bonded to 14 is bonded to body cover A for additional support and comfort.

1 RELEASE BUTTON
2 PUSHING BAR INSIDE A & B
3 SUPPORT BRACKET SIDE A
4 SUPPORT BRACKET SIDE B
5 HIGH DENSITY MEMORY FOAM (FAST SPRING)
6 HINGE SHAFT
7 HINGE SHAFT
8 RUBBER FEET
9 LOCKING SIDE BRACKET
10 BODY COVER B
11 SPRING
12 SPRING
13 BODY COVER A
14 HIGH DENSITY MEMORY FOAM (SLOW SPRING)
15 HIGH DENSITY MEMORY FOAM (SLOW SPRING)

OPERATION In operation one uses the adjustable hairstyle protecting unit in a normal manner as a standard pillow would be used while sleeping or resting except for the additional features that this unit provides. The user would first, bring out the adjustable bar 1,2,3,4,6,7,8,9,11,12 that is securely fitted into and attached to Body Cover B 10 on the back , then push the release/lock button 1 to set the unit into the users desired elevated height position. By releasing the same release/lock button 1 the unit will lock into the Locking Side Bracket 9 multiple positions. From that point, the user would find their location, adjust the unit to their desirable position and enjoy the comfort of the conforming three layer memory foam that contours the neck with its design 5, 15,14.

I claim:

1. A adjustable hairstyle protecting pillow unit, comprising:

an upper portion of a three layer memory foam insert having a wide u-shape at the top for holding the neck and lower head; a lightweight plastic body cover having a front and a back is bonded together to the memory foam layers; an internal system that operates an adjustable bar to be set in multiple height positions using a push release/lock button and locking side brackets; a lightweight plastic support base covering said internal system; said support base is affixed between the front and back body covers; the adjustable bar rests in the back body cover until it is removed and adjusted by said user; two non-slip grips are located on the bottom of the adjustable bar.

* * * * *